US006287214B1

(12) United States Patent
Satoh

(10) Patent No.: US 6,287,214 B1
(45) Date of Patent: Sep. 11, 2001

(54) GOLF CLUB HEAD

(75) Inventor: Tokuo Satoh, Fuchu (JP)

(73) Assignee: Ryobi Limited, Fuchu (JP)

( * ) Notice: Subject to any disclaimer, the term of this patent is extended or adjusted under 35 U.S.C. 154(b) by 0 days.

(21) Appl. No.: 09/373,210

(22) Filed: Aug. 12, 1999

(30) Foreign Application Priority Data

Sep. 16, 1998 (JP) ..... P10-261045

(51) Int. Cl.[7] ..... A63B 53/02
(52) U.S. Cl. ..... 473/305; 473/345
(58) Field of Search ..... 473/305, 306, 473/307, 308, 309, 310, 311, 312, 313, 314, 315, 345, 244, 245, 246

(56) References Cited

U.S. PATENT DOCUMENTS 4,607,846 * 8/1986 Perkins .
5,039,098 * 8/1991 Pelz .
5,485,998 * 1/1996 Kobayashi .
5,540,435 * 7/1996 Kawasaki .
5,709,614 * 1/1998 Horiba .
6,001,027 * 12/1999 Hansberger .
6,089,991 * 7/2000 Yeh .

FOREIGN PATENT DOCUMENTS

443439 * 2/1936 (GB) ..... 273/80.7

* cited by examiner

*Primary Examiner*—Sebastiano Passaniti
(74) *Attorney, Agent, or Firm*—Oliff & Berridge, PLC

(57) ABSTRACT

A golf club head comprises a hosel into which the front-end portion of a shaft for a golf club is inserted. The hosel has at the lower and inside portion thereof a bottom wall. A balance adjusting screw screws on the bottom wall. A tapped hole formed on the bottom wall, for receiving the balance adjusting screw may pass through the bottom wall so as to cause a space defined by a crown, a face and a sole to communicate with the inside of the hosel. The tapped hole may have a tapered portion formed on the periphery of the tapped hole, which locates at the side of the hosel.

5 Claims, 4 Drawing Sheets

GOLF CLUB HEAD

BACKGROUND OF THE INVENTION

1. Field of the Invention

The present invention relates to a golf club head, and especially to a hollow metal club head.

2. Description of the Related Art

In general, a hollow metal head for a golf club is composed of four parts, i.e., a crown, a face, a sole and a hosel.

FIG. 6 is a partial sectional view illustrating a conventional hollow metal head. The metal head P1 is composed of a crown C2, a face (not shown), a sole S2 and a hosel H2. The hosel H2 has a shaft insertion hole 10, which extends obliquely upward so as to open. The bottom wall 11 closes the lower end of the shaft insertion hole 10. Accordingly, in the metal head P1, the inside 13 of the hosel H2 and a space 12 defined by the crown C2, the face (not shown) and the sole S2 are separated from each other by means of the above-mentioned bottom wall 11. The front-end portion of a shaft 9 for a golf club is inserted into the shaft insertion hole 10 of the hosel H2 and fixed thereto. The conventional metal head P1 described above will hereinafter be referred to as the "prior art 1".

FIG. 7 is a partial sectional view illustrating another conventional hollow metal head. The metal head P2 is composed of a crown C3, a face (not shown), a sole S3 and a hosel H3. The hosel H3 has a shaft insertion hole 14, which extends obliquely upward so as to open. A bottom wall 15 having a through-hole 15*a* is formed at the lower end of the shaft insertion hole 14. Accordingly, in the metal head P2, the inside 17 of the hosel H3 and a space 16 defined by the crown C3, the face (not shown) and the sole S3 communicate with each other through the through-hole 15*a* of the bottom wall 15. The front-end portion of a shaft 9 for a golf club is inserted into the shaft insertion hole 14 of the hosel H3 and fixed thereto. The conventional metal head P2 described above will hereinafter be referred to as the "prior art 2".

Irregularity in weight of golf club heads usually occurs when manufacturing them. However, in any one of the prior arts 1 and 2, it is impossible to compensate the above-mentioned irregularity and in addition, to change uniformly the position of the center of gravity of the head. The front end of the shaft 9 comes into contact with the bottom wall 11, 15 of the hosel H2, H3 and is fixed thereto in such a condition by means of a fastening means such as an adhesive. It is therefore impossible to adjust the mounting position of the shaft 9 relative to the hosel H2, H3.

In the prior art 1, the inside 13 of the hosel H2 and the space 12 defined by the crown C2, the face (not shown) and the sole S2 are separated from each other by means of the bottom wall 11. Such a construction causes the following problems. More specifically, with respect to manufacture of the golf club head, when there are applied, for example, a step of forming the crown C2, the face (not shown) and the hosel H2 as an integral body and a subsequent step of welding the sole S2 to the above-mentioned integral body, there is a possibility that a part of a weld bead may separate in a molten state from the weld bead during forming it and solidifies so as to form a metallic piece, which is freely movable within the above-mentioned space 12. The space 12 is insulated from the outside, with the result that the inside of the head cannot be cleaned and the above-mentioned metallic piece cannot be discharged outside. The existence of the metallic piece remaining in the inside of the head causes the occurrence of the noise when using the golf club head.

On the contrary, in the prior art 2, the bottom wall 15 of the hosel H3 has the through-hole 15*a* formed thereon, with the result that the inside of head can be cleaned through the through-hole 15*a* and the above-mentioned metallic piece can be removed. However, a shoulder portion is formed on the periphery of the through-hole 15*a,* which locates at the side of the hosel H3, so as to project perpendicularly to the inner surface of the hosel H3. Accordingly, it is not easy to insert a flexible tube for cleaning the inside of the head into the through-hole 15*a,* leading to a complicated cleaning operation. In addition, an adhesive for fixing the shaft 9 to the hosel H3 may pass through the above-mentioned through-hole 15*a* into the inside of the head and solidify to form a lump of the adhesive. The thus formed lump of the adhesive causes the occurrence of the noise when using the golf club head. A grip mounted on the rear end of the shaft 9 has an air hole formed on its bottom wall portion. There may be caused a problem that water coming into the shaft 9 through the air hole infiltrates into the head through the through-hole 14.

SUMMARY OF THE INVENTION

An object of the present invention is therefore to provide a golf club head, which permits to compensate the irregularity in weight of the golf club head, to change uniformly the position of the center of gravity of the head and to adjust the mounting position of the shaft relative to the hosel.

In order to attain the aforementioned object, a golf club head of the present invention comprises a hosel into which a front end portion of a shaft for a golf club is inserted, said hosel having at a lower and inside portion thereof a bottom wall, wherein:

a balance adjusting screw screws on said bottom wall.

In addition to attainment of the object mentioned above, in order to permit to clean the inside of the head, a tapped hole formed on the above-mentioned bottom wall, for receiving the balance adjusting screw may pass through the bottom wall so as to cause a space defined by a crown, a face and a sole to communicate with an inside of the hosel.

In addition to attainment of the object mentioned above, in order to facilitate the cleaning of the inside of the head, the above-mentioned tapped hole may have a tapered portion formed on the periphery of the tapped hole, which locates at the side of the hosel.

The above-mentioned balance adjusting screw may have a head portion, which is to locate in the shaft insertion hole so that the front-end portion of the shaft can come into contact with the head portion.

A plate may be held between the balance adjusting screw and the front-end portion of the shaft.

DETAILED DESCRIPTION OF THE PREFERRED EMBODIMENTS

Now, embodiments of a golf club head of the present invention will be described in detail below with reference to the accompanying drawings.

Figure 1:
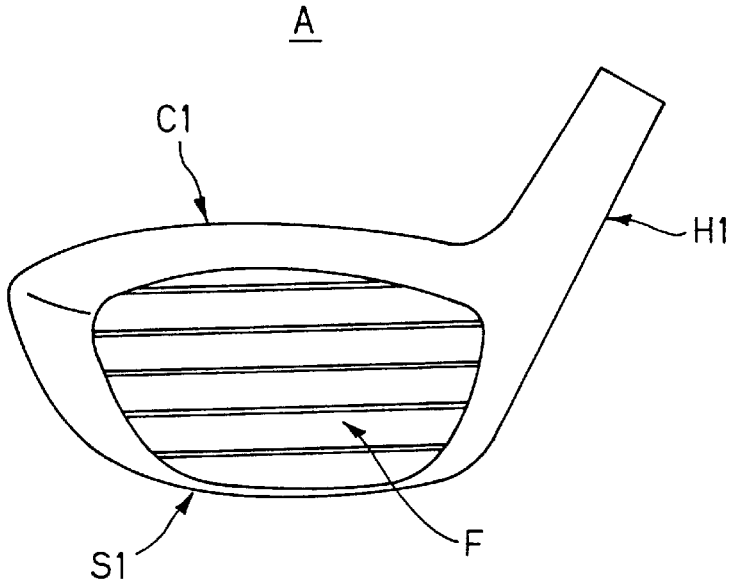
FIG. 1 is a front view illustrating a golf club head of the first embodiment of the present invention.

Description will be given of a golf club head of the first embodiment of the present invention with reference to FIGS. 1 to 3. The golf club head A as shown in FIGS. 1 to 3, which is formed into a hollow metal head in replacement of the conventional wood club head, is composed of a crown C1, a face F, a sole S1 and a hosel H1.

Figure 2:
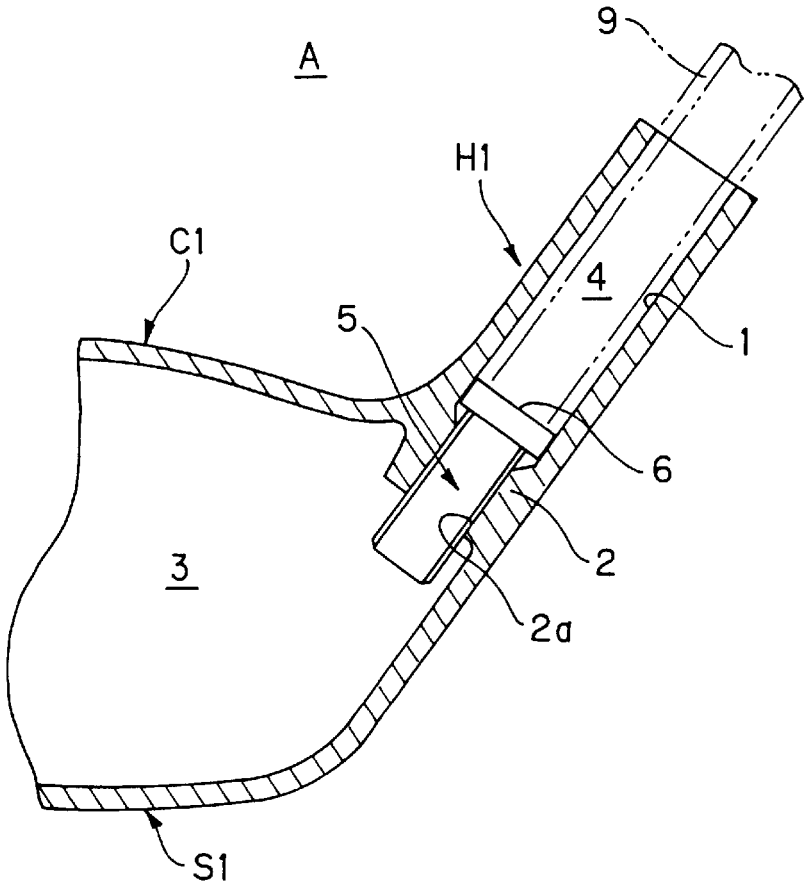
FIG. 2 is a partial sectional view illustrating the golf club head as shown in FIG. 1.

The hosel H1 has a shaft insertion hole 1, which extends obliquely upward so as to open, as shown in FIG. 2. A bottom wall 2 having a tapped hole 2*a* is formed at the lower end of the shaft insertion hole 1. The tapped hole 2*a* is coaxial with the shaft insertion hole 1. The tapped hole 2*a* has a diameter, which is slightly smaller than that of the shaft insertion hole 1. Accordingly, the inside 4 of the hosel H1 and a space 3 defined by the crown C1, the face F and the sole S1 communicate with each other through the tapped hole 2*a* of the bottom wall 2.

Figure 3:
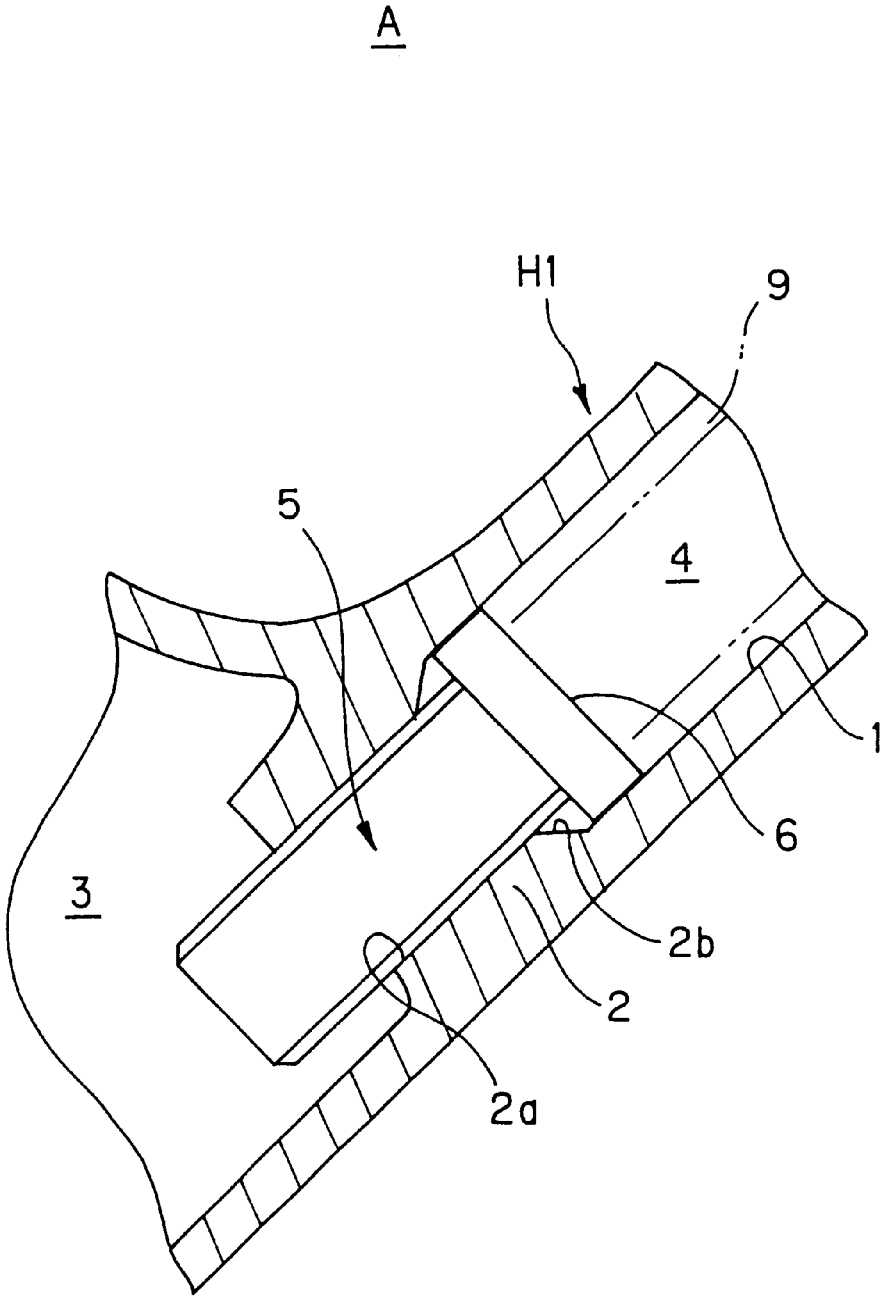
FIG. 3 is an enlarged sectional view illustrating essential portions as shown in FIG. 2.

The tapped hole 2*a* has a tapered portion 2*b* formed on the periphery of the tapped hole 2*a* as shown in FIG. 3, which locates at the side of the hosel H1. Accordingly, the inner peripheral surface defining the shaft insertion hole 1 of the hosel H1 smoothly connects with the tapped hole 2*a* through the tapered portion 2*b*.

A balance adjusting screw 5 screws into the above-mentioned tapped hole 2*a*. More specifically, the balance adjusting screw 5 has at its one end a head portion 6 and screws into the tapped hole 2*a* so that the head portion 6 locates in the shaft insertion hole 1. The balance adjusting screw 5 is formed for example of material having a relatively large specific gravity such as tungsten, copper, brass and iron, or material having a relatively small specific gravity, such as aluminum and plastic. There is used the balance adjusting screw 5, which is formed of the appropriate of these materials in view of compensation for the irregularity in weight of the golf club head and change in position of the center of gravity.

A method for manufacturing the above-mentioned golf club head A will be described below. First, there is prepared a club head body in which the crown C1, the face F and the hosel H1 provided with the bottom wall 2 having the tapped hole 2*a* are formed integrally with each other. Then, there is prepared the sole S1, which is formed separately from the club head body. Either the forging method or the casting method may be applied for the formation of the club head body and the sole S1. Then, the sole S1 is welded to the lower peripheral opening edge of the club head body.

Then, a flexible tube (not shown) for cleaning the inside of the head is inserted into the head through the shaft insertion hole 1 of the hosel H1 and the tapped hole 2*a* of the bottom wall 2 so as to clean the inside of the head by means of the flexible tube. A smooth connection of the inner peripheral surface defining the shaft insertion hole 1 of the hosel H1 with the tapped hole 2*a* through the tapered portion 2*b* makes it very easy to insert the flexible tube into the tapped hole 2*a*.

Then, the balance adjusting screw 5 is inserted into the shaft insertion hole 1 of the hosel H1 and screwed into the tapped hole 2*a* of the bottom wall 2. It is possible to compensate the irregularity in weight of the golf club head and change in position of the center of gravity by means of the balance adjusting screw 5. More specifically, the irregularity in weight of the entirety of the golf club head A can be compensated by using the balance adjusting screw 5, which is formed of an appropriate material. The position of the center of gravity of the golf club head A can be changed by adjusting a screwing amount of the balance adjusting screw 5. When the center of gravity of the golf club head A is required to be shifted to a high position, the screwing amount of the balance adjusting screw 5 is kept small so as to maintain a high mounting position of the balance adjusting screw 5. On the contrary, when the center of gravity of the golf club head A is required to be shifted to a low position, the screwing amount of the balance adjusting screw 5 is kept large so as to maintain a low mounting position of the balance adjusting screw 5. Such a shift of the center of gravity of the golf club head A makes it possible to realize a trajectory of a golf ball in accordance with preference of a golf player, thus permitting to provide for example a golf club head for a high or low trajectory.

After the completion of proper determination of the mounting position of the balance adjusting screw 5 in view of compensation for the irregularity in weight of the golf club head and change in position of the center of gravity, the front end portion of a shaft 9 is inserted into the shaft insertion hole 1 of the hosel H1 and adhered thereto. The front end of the shaft 9 comes into contact with the head portion 6 of the balance adjusting screw 5 whose mounting position can be changed by adjusting the screwing amount of the balance adjusting screw 5 in a manner as described above. The mounting position of the shaft 9 can therefore be adjusted in accordance with the mounting position of the balance adjusting screw 5. It is also possible to change the mounting position of the shaft 9 by disposing an appropriate spacer between the balance adjusting screw 5 and the front end of the shaft 9. Such change in the mounting position of the shaft 9 in this manner makes it possible to compensate the irregularity in length of the shaft 9, which occurs when cutting a blank shaft for the shaft 9, as well as the irregularity in depth of the shaft insertion hole 1, which occurs when forming the hosel H1, thus permitting an easy manufacture of the golf club having an appropriate length.

The tapped hole 2*a* formed on the bottom wall 2 of the hosel H1 can be closed by the balance adjusting screw 5. An adhesive for fixing the shaft 9 to the hosel H1 does not penetrate into the head, resulting in prevention of occurrence of the noise due to solidification of the adhesive penetrating into the head.

Figure 4:
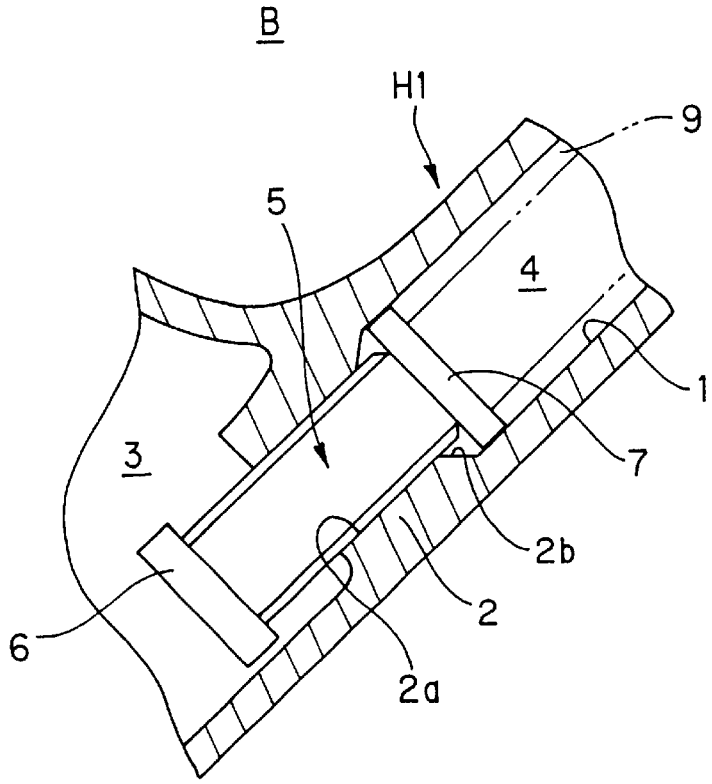
FIG. 4 is an enlarged sectional view illustrating essential portions of a golf club head of the second embodiment of the present invention.

Now, description will be given of a golf club head of the second embodiment of the present invention with reference to FIG. 4. The golf club head B of the second embodiment of the present invention is identical with the golf club head A of the first embodiment of the present invention except that the balance adjusting screw 5 is disposed upside down and a plate 7 is held between the balance adjusting screw 5 and the shaft 9. The same reference numerals are given to the same constructional components and description thereof is omitted.

The balance adjusting screw 5 is inserted into the club head body from its lower end opening and screwed into the tapped hole 2*a* formed on the bottom wall 2 of the hosel H1 so that the head portion 6 locates in the space 3, prior to the step of welding the sole to the club head body in which the crown, the face and the hosel H1 provided with the bottom wall 2 having the tapped hole 2*a* are formed integrally with each other.

The plate 7 is formed into a disc having a slightly smaller diameter than that of the shaft insertion hole 1 of the hosel H1. The plate 7 is held between the tip end of the balance adjusting screw 5 and the front end of the shaft 9 so as to regulate the mounting position of the shaft 9. A plurality of plates having the same or different thickness may be prepared as the plate 7 so as to expand the range of regulation of the mounting position of the shaft 9. It is possible to expand the ranges of compensation for the irregularity in weight of the golf club head B and change in position of the center of gravity by forming the plurality of plates mentioned above of materials having the different specific gravity from each other and using the optimal of them alone or in combination.

A method for manufacturing the above-mentioned golf club head B will be described below. First, there is prepared, in the same manner as mentioned in the first embodiment of the present invention, a club head body in which the crown, the face and the hosel provided with the bottom wall 2 having the tapped hole 2*a* are formed integrally with each other. Then, there is prepared the sole, which is formed separately from the club head body.

The balance adjusting screw 5 is inserted into the club head body from its lower end opening and screwed into the tapped hole 2*a* formed on the bottom wall 2 of the hosel H1 so that the head portion 6 locates in the space 3. It is possible to compensate the irregularity in weight of the golf club head and change in position of the center of gravity by means of the balance adjusting screw 5. More specifically, the irregularity in weight of the entirety of the golf club head B can be compensated by using the balance adjusting screw 5, which is formed of an appropriate material. Adjusting a screwing amount of the balance adjusting screw 5 can change the position of the center of gravity of the golf club head B. When the center of gravity of the golf club head B is required to be shifted to a high position, the screwing amount of the balance adjusting screw 5 is kept large so as to maintain a high mounting position of the balance adjusting screw 5. On the contrary, when the center of gravity of the golf club head B is required to be shifted to a low position, the screwing amount of the balance adjusting screw 5 is kept small so as to maintain a low mounting position of the balance adjusting screw 5. Such a shift of the center of gravity of the golf club head B makes it possible to realize a trajectory of a golf ball in accordance with preference of a golf player, thus permitting to provide for example a golf club head for a high or low trajectory.

Then, the sole is welded to the lower peripheral opening edge of the club head body.

After the completion of proper determination of the mounting position of the balance adjusting screw 5 in view of compensation for the irregularity in weight of the golf club head and change in position of the center of gravity, and the completion of the step of welding the sole to the club head body, the plate 7 is inserted into the shaft insertion hole 1 of the hosel H1 so as to come into contact with the tip end of the balance adjusting screw 5. Then, the front-end portion of a shaft 9 is inserted into the shaft insertion hole 1 of the hosel H1 and adhered thereto. The front end of the shaft 9 comes into contact with the above-mentioned plate 7 hose position can be changed by adjusting the screwing amount of the balance adjusting screw 5. The mounting position of the shaft 9 can therefore be adjusted in accordance with the mounting position of the balance adjusting screw 5. It is possible to expand the range of regulation of the mounting position of the shaft 9 with the use of a plurality of plates 7. Such change in the mounting position of the shaft 9 in this manner makes it possible to compensate the irregularity in length of the shaft 9, which occurs when cutting a blank shaft for the shaft 9, as well as the irregularity in depth of the shaft insertion hole 1, which occurs when forming the hosel H1, thus permitting an easy manufacture of the golf club having an appropriate length.

The tapped hole 2*a* formed on the bottom wall 2 of the hosel H1 can be closed by the balance adjusting screw 5. An adhesive for fixing the shaft 9 to the hosel H1 does not penetrate into the head, resulting in prevention of occurrence of the noise due to solidification of the adhesive penetrating into the head.

Now, description will be given of a golf club head of the third embodiment of the present invention with reference to FIG. 5. The golf club head C of the third embodiment of the present invention is identical with the golf club head B of the second embodiment of the present invention except that the balance adjusting screw 8 has no head portion. The same reference numerals are given to the same constructional components and description thereof is omitted.

Figure 5:
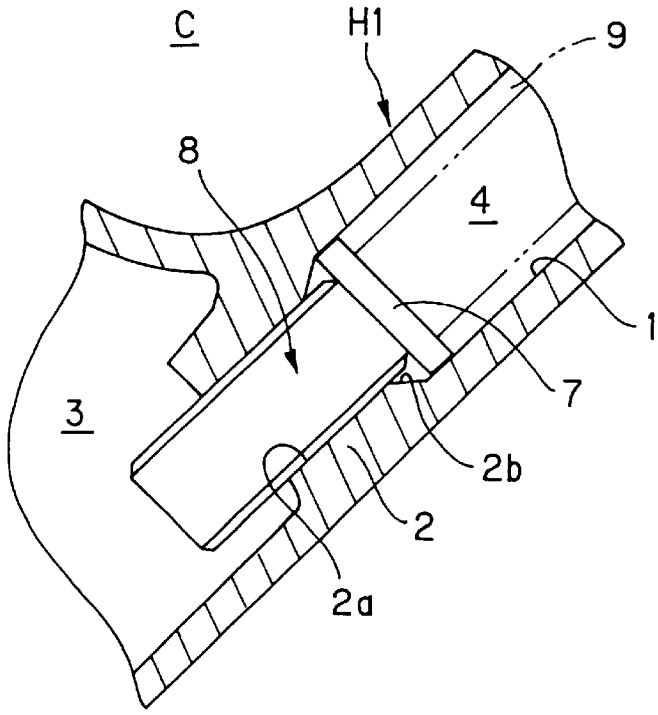
FIG. 5 is an enlarged sectional view illustrating essential portions of a golf club head of the third embodiment of the present invention.
Figure 6:
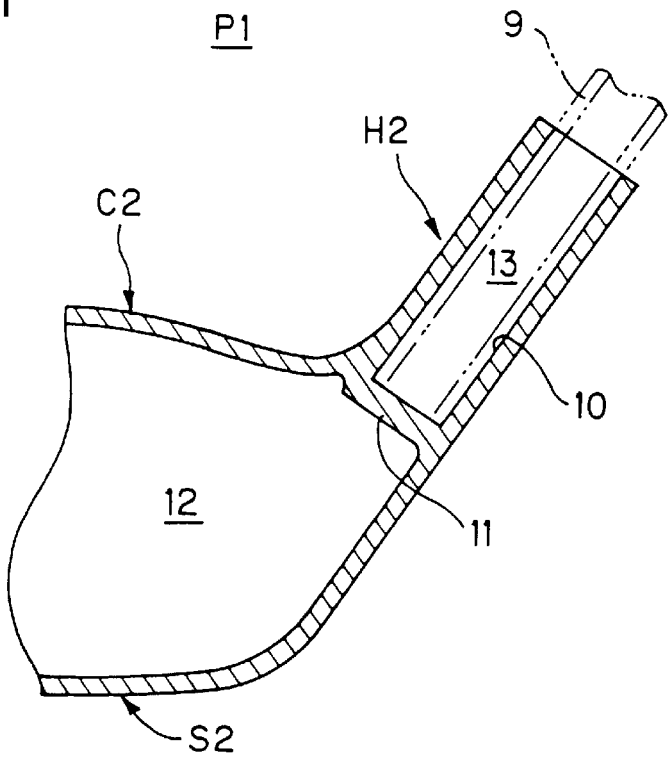
FIG. 6 PRIOR ART
FIG. 6 is a partial sectional view illustrating a conventional golf club head.
Figure 7:
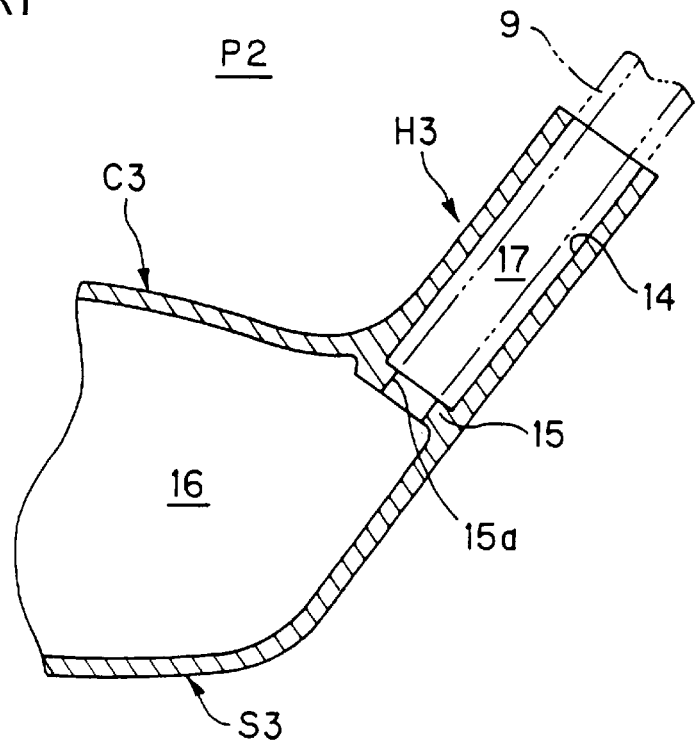
FIG. 7 PRIOR ART
FIG. 7 is a partial sectional view illustrating another conventional golf club head.

The balance adjusting screw 8 does not have any head portion as shown in FIG. 5, but has a groove (not shown) in replacement of the had portion, into which the tip end of a tool such as a screwdriver can be inserted.

A method for manufacturing the above-mentioned golf club head C will be described below. First, there is prepared, in the same manner as mentioned in the first embodiment of the present invention, a club head body in which the crown, the face and the hosel provided with the bottom wall 2 having the tapped hole 2*a* are formed integrally with each other. Then, there is prepared the sole, which is formed separately from the club head body. Then, the sole is welded to the lower peripheral opening edge of the club head body.

Then, a flexible tube (not shown) for cleaning the inside of the head is inserted into the head through the shaft insertion hole 1 of the hosel H1 and the tapped hole 2*a* of the bottom wall 2 so as to clean the inside of the head by means of the flexible tube. A smooth connection of the inner peripheral surface defining the shaft insertion hole 1 of the hosel H1 with the tapped hole 2*a* through the tapered portion 2*b* makes it very easy to insert the flexible tube into the tapped hole 2*a*.

Then, the balance adjusting screw 8 is inserted into the shaft insertion hole 1 of the hosel H1 and screwed into the tapped hole 2*a* of the bottom wall 2. It is possible to compensate the irregularity in weight of the golf club head and change in position of the center of gravity by means of the balance adjusting screw 8. More specifically, the irregularity in weight of the entirety of the golf club head A can be compensated by using the balance adjusting screw 8, which is formed of an appropriate material. The position of the center of gravity of the golf club head A can be changed by adjusting a screwing amount of the balance adjusting screw 8. When the center of gravity of the golf club head A is required to be shifted to a high position, the screwing amount of the balance adjusting screw 8 is kept small so as to maintain a high mounting position of the balance adjusting screw 8. On the contrary, when the center of gravity of the golf club head A is required to be shifted to a low position, the screwing amount of the balance adjusting screw 8 is kept large so as to maintain a low mounting position of the balance adjusting screw 8. Such a shift of the center of gravity of the golf club head A makes it possible to realize a trajectory of a golf ball in accordance with preference of a golf player, thus permitting to provide for example a golf club head for a high or low trajectory.

After the completion of proper determination of the mounting position of the balance adjusting screw 8 in view of compensation for the irregularity in weight of the golf club head and change in position of the center of gravity, the plate 7 is inserted into the shaft insertion hole 1 of the hosel H1 so as to come into contact with the tip end of the balance adjusting screw 8. Then, the front-end portion of a shaft 9 is inserted into the shaft insertion hole 1 of the hosel H1 and adhered thereto. The front end of the shaft 9 comes into contact with the above-mentioned plate 7 whose position can be changed by adjusting the screwing amount of the balance adjusting screw 8. The mounting position of the shaft 9 can therefore be adjusted in accordance with the mounting position of the balance adjusting screw 8. It is possible to expand the range of regulation of the mounting position of the shaft 9 with the use of a plurality of plates 7. Such change in the mounting position of the shaft 9 in this manner makes it possible to compensate the irregularity in length of the shaft 9, which occurs when cutting a blank shaft for the shaft 9, as well as the irregularity in depth of the shaft insertion hole 1, which occurs when forming the hosel H1, thus permitting an easy manufacture of the golf club having an appropriate length.

The tapped hole 2*a* formed on the bottom wall 2 of the hosel H1 can be closed by the balance adjusting screw 8. An adhesive for fixing the shaft 9 to the hosel H1 does not penetrate into the head, resulting in prevention of occurrence of the noise due to solidification of the adhesive penetrating into the head.

In the golf club heads A, B and C of the first to third embodiments of the present invention described above, the tapped hole 2*a* formed on the bottom wall 2 of the hosel H1, for receiving the balance adjusting screw 5, 8 passes through the bottom wall 2 so as to cause the space 3 defined by the crown C1, the face F and the sole S1 to communicate with the inside 4 of the hosel H1. However, the above-mentioned tapped hole 2*a* may not pass through the bottom wall 2, if no cleaning of the space 3 is required.

The golf club heads A, B and C of the first to third embodiments of the present invention are formed into a hollow metal head in replacement of the conventional wool club head. The present invention may however be applied to a hollow iron metal head.

According to the present invention as described in detail, since the balance adjusting screw screws on the bottom wall formed at the lower and inside portion of the hosel, it is possible to easily compensate the irregularity in weight of the golf club head, to change uniformly the position of the center of gravity of the head and to adjust the mounting position of the shaft relative to the hosel.

When the tapped hole formed on the above-mentioned bottom wall, for receiving the balance adjusting screw passes through the bottom wall so as to cause the space defined by the crown, the face and the sole to communicate with the inside of the hosel, it is possible to easily carry out the cleaning of the above-mentioned space.

When the above-mentioned tapped hole has a tapered portion formed on the periphery of the tapped hole, which locates at the side of the hosel, it is possible to insert very easily a flexible tube for cleaning the above-mentioned space so as to facilitate the cleaning thereof.

What is claimed is:

1. A golf club head comprising a hosel having a shaft insertion hole into which a front end potion of a shaft for a golf club is inserted, said hosel having at a lower and inside portion thereof a bottom wall, wherein:

a balance adjusting screw screws in a tapped hole formed on said bottom wall so that a position of said balance adjusting screw relative to said golf club bead is adjustable, said balance adjusting screw having a head portion, which is located in said shaft insertion hole so that said front end portion of said shaft can come into contact with said head potion; and said golf club head has a hollow, with which the tapped hole communicates.

2. The golf club head as claimed in claim 1, wherein:

said tapped hole has a tapered portion formed on a periphery of said tapped hole, said tapered portion being located on a side of said hosel.

3. The golf club head as claimed in claim 1, wherein:

a plate is held between said balance adjusting screw and said front-end portion of said shaft.

4. A golf club head comprising a hosel having a shaft insertion hole into which a front end portion of a shaft for a golf club is inserted, said hosel having at a lower and inside portion thereof a bottom wall, wherein:

a balance adjusting screw screws in a tapped hole formed on said bottom wall so that a position of said balance adjusting screw relative to said golf club head is adjustable;

said golf club head has a hollow, with which said tapped hole communicates; and a plate is held between said balance adjusting screw and said front-end portion of said shaft.

5. The golf club head as claimed in claim 4, wherein said tapped hole has a tapered portion formed on a periphery of said tapped hole, said tapered portion locating at a side of said hosel.

* * * * *